US006821700B2

(12) United States Patent
Lewis

(10) Patent No.: US 6,821,700 B2
(45) Date of Patent: Nov. 23, 2004

(54) APPARATUS AND METHOD FOR NON-INTERACTIVE ELECTROPHOTOGRAPHIC DEVELOPMENT AND CARRIER BEAD COMPOSITION THEREFOR

(75) Inventor: Richard B. Lewis, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 3 days.

(21) Appl. No.: 10/322,041

(22) Filed: Dec. 17, 2002

(65) Prior Publication Data

US 2004/0115552 A1 Jun. 17, 2004

(51) Int. Cl.[7] ..... G03G 9/113; G03G 13/09; G03G 15/09

(52) U.S. Cl. ..... 430/111.1; 430/111.35; 430/122; 399/267; 399/272

(58) Field of Search ..... 430/111.1, 111.35, 430/122; 399/267, 272

(56) References Cited

U.S. PATENT DOCUMENTS 5,110,703 A * 5/1992 Nagatsuka et al. ..... 430/111.35
5,890,041 A 3/1999 Lewis ..... 399/276
5,946,534 A 8/1999 Lewis ..... 399/272
6,284,421 B1 * 9/2001 Matsuzaki et al. ..... 430/111.1

* cited by examiner

*Primary Examiner*—John L Goodrow
(74) *Attorney, Agent, or Firm*—Mark Z. Dudley

(57) ABSTRACT

An apparatus and method for non-interactive, dry powder development of electrostatic images includes an image bearing member bearing an electrostatic image; two component developer comprising toner and permanently magnetized thickly coated carrier beads, the coated carrier beads having magnetizable core radius r, average radius a, and magnetization $M_b$, with the ratio r/a being given as K; a developer transporting member having a thickness t for transporting a developer layer of the two component developer, wherein the layer is spaced close to and out of contact with the image bearing member, a multipole magnet member disposed in close proximity to the transporting member and moving relative to it so as to sweep poles across its surface, the magnet member having a periodic magnetization of spatial frequency k and a peak magnetization $M_0$ wherein $M_b$, t, k, and $M_0$, are chosen such that $M_b$ is sufficiently large to prevent the escape of developer, a quantity C in the equation $$C = 2.2\left(\frac{M_0}{M_b}\right)\frac{1}{K^3}e^{-kt}ka$$

is greater than about ⅓, and the ratio K is a quantity less than about ¾, and preferably less than about ½, so as to weaken bead-bead interaction and thus enhance the desired provision of a compressed developer layer.

17 Claims, 5 Drawing Sheets

APPARATUS AND METHOD FOR NON-INTERACTIVE ELECTROPHOTOGRAPHIC DEVELOPMENT AND CARRIER BEAD COMPOSITION THEREFOR

BACKGROUND OF THE PRESENT INVENTION

The invention relates generally to an electrophotographic printing machine and, more particularly, to the non-interactive development of electrostatic images.

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic image on the photoconductive member corresponding to the informational areas contained within the document. After the electrostatic image is formed on the photoconductive member, the image is developed by bringing a developer material into effective contact therewith. Typically, the developer material comprises toner particles bearing electrostatic charges chosen to cause them to move toward and adhere to the desired portions of the electrostatic image. The resulting physical image is subsequently transferred to a copy sheet. Finally, the copy sheet is heated or otherwise processed to permanently affix the powder image thereto in the desired image-wise configuration.

Development may be interactive or non-interactive depending on whether toner already on the image may or may not be disturbed or removed by subsequent development procedures. Sometimes the terms scavenging and non-scavenging are used interchangeably with the terms interactive and non-interactive. Non-interactive development is most useful in color systems when a given color toner must be deposited on an electrostatic image without disturbing previously applied toner deposits of a different color, or cross-contaminating the color toner supplies. This invention relates to such image-on-image, non-interactive development.

Apparently useful non-interactive development methods known to the inventor work by generating a powder cloud in the gap between the photoreceptor and another member which serves as a development electrode. It is generally observed that this gap should be as small as possible, as small as 0.010 inches or smaller. Generally, the larger the gap, the larger become certain image defects in the development of fine lines and edges. The lines do not develop to the correct width, lines near solid areas are distorted, and the edges of solids are softened, especially at corners. It is believed that these defects are due to arches in the image electric fields over lines and at the edges of solid areas. In these arches electric field lines from image charges loop up and return to the photoreceptor ground plane instead of reaching across through the cloud to the development electrode. Defects result because toner in the cloud moves generally along field lines and cannot cross them into the arches, with the result that the deposited toner distribution does not correspond to image charge distribution. Defects due to field arches are less serious in interactive two component development because toner is carried into the arches by carrier particles. Nor are they very serious in interactive single component development exemplified by U.S. Pat. No. 4,292,387 to Kanbe et al. because a strong, cross-gap AC field is superposed which overcomes the aforementioned field arch patterns.

In non-scavenging systems of the kind disclosed in the patents cited below, cross gap AC fields are also applied. However, it is important to realize that if such fields are made too strong, the system will become interactive due to toner impact on already developed images. Thus a system may image well at strong fields and develop non interactively at weak fields, but not do both simultaneously. The development electrode and its role in determining electric field structure is described, for example by H. E. J. Neugebauer in Xerography and Related Processes, Dessauer and Clark, Focal Press 1965. Powder cloud development is described, for example, in the paper "High Sensitivity Electrophotographic Development" by R. B. Lewis and H. M. Stark in Current Problems in Electrophotography, Berg and Hauffe, Walter de Gruyter, Berlin 1972.

U.S. Pat. No. 4,868,600 to Hays et al discloses a non-interactive development system wherein toner is first developed from a two-component developer onto a metal-cored donor roll and thereafter disturbed into a powder cloud in the narrow gap between the donor roll and an electrostatic image. Development fields created between the donor roll core and the electrostatic image harvest some of the toner from the cloud onto the electrostatic image, thus developing it without physically disturbing it. In this method the powder cloud generation is accomplished by thin, AC biased wires strung across the process direction and within the development gap. The wires ride on the toner layer and are biased relative to the donor roll core. The method is subject to wire breakage and to the creation of image defects due to wire motion, and these problems increase as the process width is increased. In this system it has been found important for image defect reduction to minimize the gap between the donor and the surface of the electrostatic image in order to create a close development electrode. Gap spacings of about 0.010 inches are characteristic. They would be smaller were it practical to maintain the necessary tolerances.

U.S. Pat. No. 4,557,992 to Haneda et al. describes a non-interactive magnetic brush development method wherein a two component employing magnetically soft carrier materials is carried into close proximity to an electrostatic image and caused to generate a powder cloud by the developer motion, sometimes aided by an AC voltage applied across the gap between the brush and the ground plane of the electrostatic image. Cloud generation directly from the surfaces of a two component developer avoids the problems created by wires. However, in practice such methods have been speed limited by their low toner cloud generation rate.

U.S. Pat. No. 5,409,791 to Kaukeinen et al. describes a non-interactive magnetic brush development method employing permanently magnetized carrier beads operating with a rotating multipole magnet within a conductive and nonmagnetic sleeve. Magnetic field lines form arches in the space above the sleeve surface and form chains of carrier beads. The developer chains are held in contact with the sleeve and out of direct contact with the photoreceptor by gradients provided by the multipole magnet. As the core rotates in one direction relative to the sleeve, the magnetic field lines beyond the sleeve surface rotate in the opposite sense, moving chains in a tumbling action which transports developer material along the sleeve surface. The strong mechanical agitation very effectively dislodges toner particles generating a rich powder cloud which can be developed to the adjacent photoreceptor surface under the influence of development fields between the sleeve and the electrostatic image. U.S. Pat. No. 5,409,791 assigned to Eastman Kodak Company is hereby incorporated by reference.

However, it has been observed that the use of bead chains according U.S. Pat. No. 5,409,791 requires that substantial clearance be provided in the development gap to avoid interactivity by direct physical contact between chains and photoreceptor. FIGS. 1 and 2, illustrates the rippled shape of the developer surface and the presence of bead chains. As a consequence of this clearance requirement the development electrode cannot be brought effectively close to the electrostatic image. With bead chains typical clearances are about 0.030 to 0.050 inches, whereas in a typical development system of the type described in U.S. Pat. No. 4,868,600 the gap between the donor and photoreceptor surface is brought down to about 0.010 inches. In devices according to U.S. Pat. No. 5,409,791 attempts to reduce the height of the developer mass by developer supply starvation have been found to result in a sparse brush structure of substantially the same height. Attempts to decrease the effective gap by increasing the electrical conductivity of the carrier have been partly successful. However, the open and stringy chain structure does not provide a very effective electrode material and problems remain, especially those related to image defects in lines and at edges.

U.S. Pat. No. 5,946,534, issued on Aug. 31, 1999 to applicant, the disclosure of which is incorporated herein by reference, discloses an apparatus and method for non-interactive, dry powder development of electrostatic images comprising: an image bearing member bearing an electrostatic image; two component developer comprising toner and permanently magnetized carrier beads, the carrier having average diameter (2*a*) and magnetization $M_b$ a developer transporting member having a thickness t for transporting a developer layer of the two component developer, the layer spaced close to and out of contact with the image bearing member, and wherein the developer layer is substantially without chains of carrier beads, a multipole magnet member disposed in close proximity behind the transporting member and moving relative to it so as to sweep poles across its surface, the magnet member having a periodic magnetization of spatial frequency k and a peak magnetization $M_0$ wherein $M_b$, t, k, and $M_0$, are chosen such that $M_b$ is sufficiently large to prevent the escape of developer, and a quantity C equal to:

$$2.2\left(\frac{M_0}{M_b}\right)e^{-kt}ka$$

is greater than about ⅓.

SUMMARY OF THE INVENTION

The present invention obviates the problems noted above by providing a non-interactive development system substantially without chains of carrier beads in the development zone, without fragile wires, and utilizing a cloud source of mechanically agitated, permanently magnetized carrier. Thus this invention is both robust and permits a spacing between a development electrode and the electrostatic image of about 0.010 inch, a spacing small enough to eliminate or significantly reduce image defects associated with fine lines and edges. This is accomplished by reducing bead-bead magnetic interaction relative to the interaction between individual beads and the field gradients applied by the multipole magnet.

There is provided apparatus for non-interactive, dry powder development of electrostatic images comprising: an image bearing member bearing an electrostatic image; two component developer comprising toner and permanently magnetized thickly coated carrier beads, said carrier beads having a radius r of the magnetized carrier bead core, a radius a of the coated carrier bead, and magnetization ($M_b$), wherein the ratio K of the radius r to the radius a is a quantity less than about ¾, a developer transporting member having a predefined thickness (t) for transporting a developer layer of said two component developer, said layer spaced close to and out of contact with said image bearing member, and wherein said developer layer is substantially without chains of carrier beads, a multipole magnet member disposed in close proximity behind said transporting member, and moving relative to it so as to sweep poles across its surface, said magnet member having a predefined periodic magnetization of spatial frequency (k) and a predefined peak magnetization ($M_0$)

There is also provided a method for generating a substantially condensed developer layer on a developer roll, comprising the steps of assembling a developer magnetic assembly said magnetic assembly having a predefined periodic magnetization of spatial frequency (k) and a predefined peak magnetization ($M_0$); enclosing the developer magnetic assembly with a sleeve of a predefined thickness (t) to form said developer roll; loading said developer roll with a single developer layer of two component developer comprising toner and permanently magnetized thickly coated carrier beads, said carrier beads having predefined average diameter (2*a*), a predefined magnetizable core diameter 2*r*, the ratio r/a being defined as K, and core magnetization ($M_b$); selecting said predefined thickness (t), said predefined periodic magnetization of spatial frequency (k), said predefined peak magnetization ($M_0$), a predefined periodic magnetization of spatial frequency (k) and a predefined peak magnetization ($M_0$), to satisfy the following relationship: wherein $M_b$, t, k, and $M_0$, are chosen such that $M_b$ is sufficiently large to prevent the escape of said developer, and that a quantity $$C = 2.2\left(\frac{M_0}{M_b}\right)\frac{1}{K^3}e^{-kt}ka$$

is greater than about ⅓; and wherein the ratio K of the radius r of the carrier bead core to the radius a of the coated carrier bead is a quantity less than about ¾, and preferably less than about ½, so as to weaken bead-bead interaction and thus enhance the desired provision of a compressed developer material layer.

DESCRIPTION OF THE INVENTION

Figure 1:
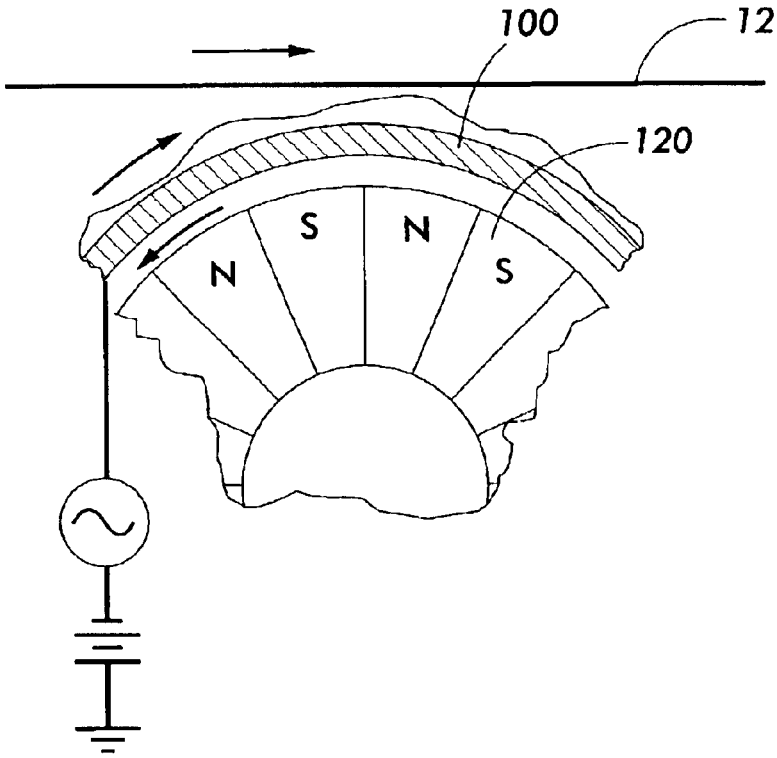
FIG. 1 PRIOR ART
FIG. 1 is a partial side view of a prior art development system.
Figure 2:
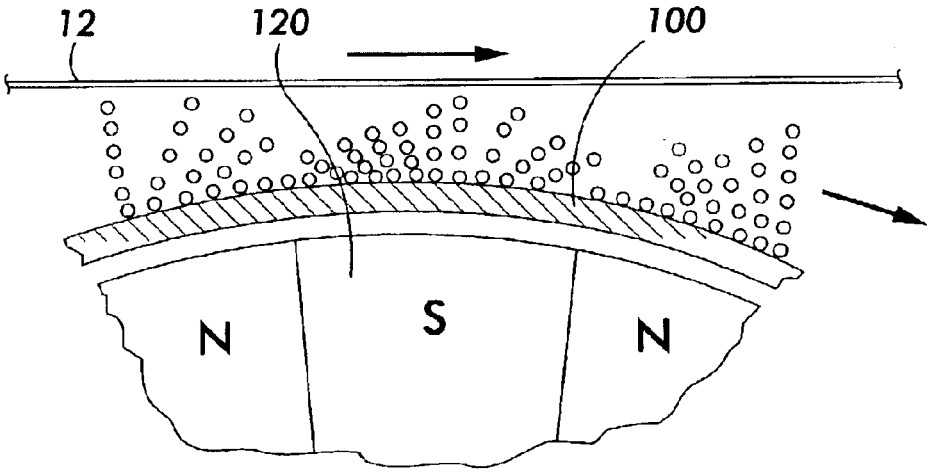
FIG. 2 PRIOR ART
FIG. 2 is a magnified view of part of the view of FIG. 1.
Figure 3:
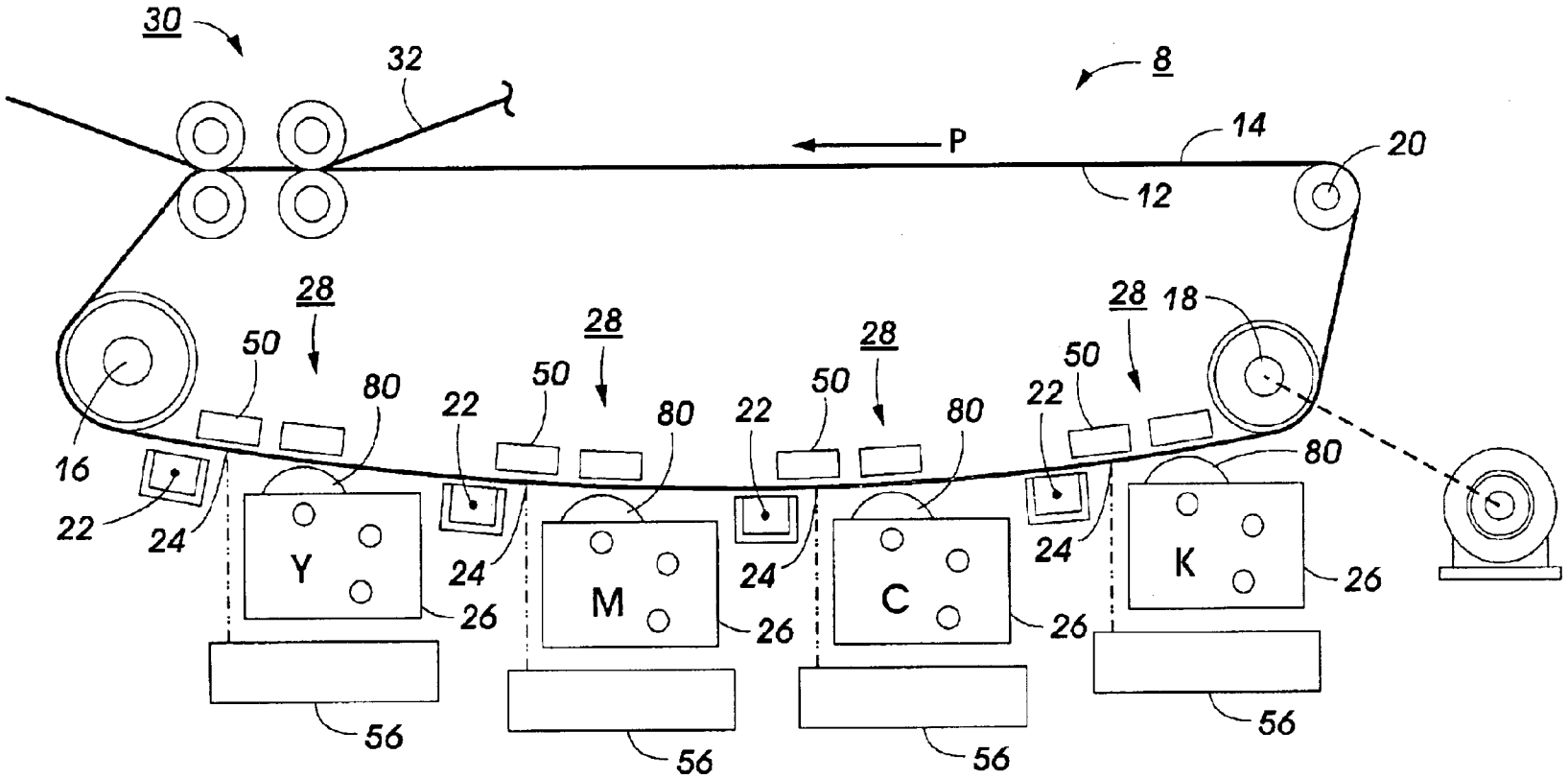
FIG. 3 is a side view, in section, of a four color xerographic reproduction machine incorporating the non-interactive developer of the present invention.
Figure 4:
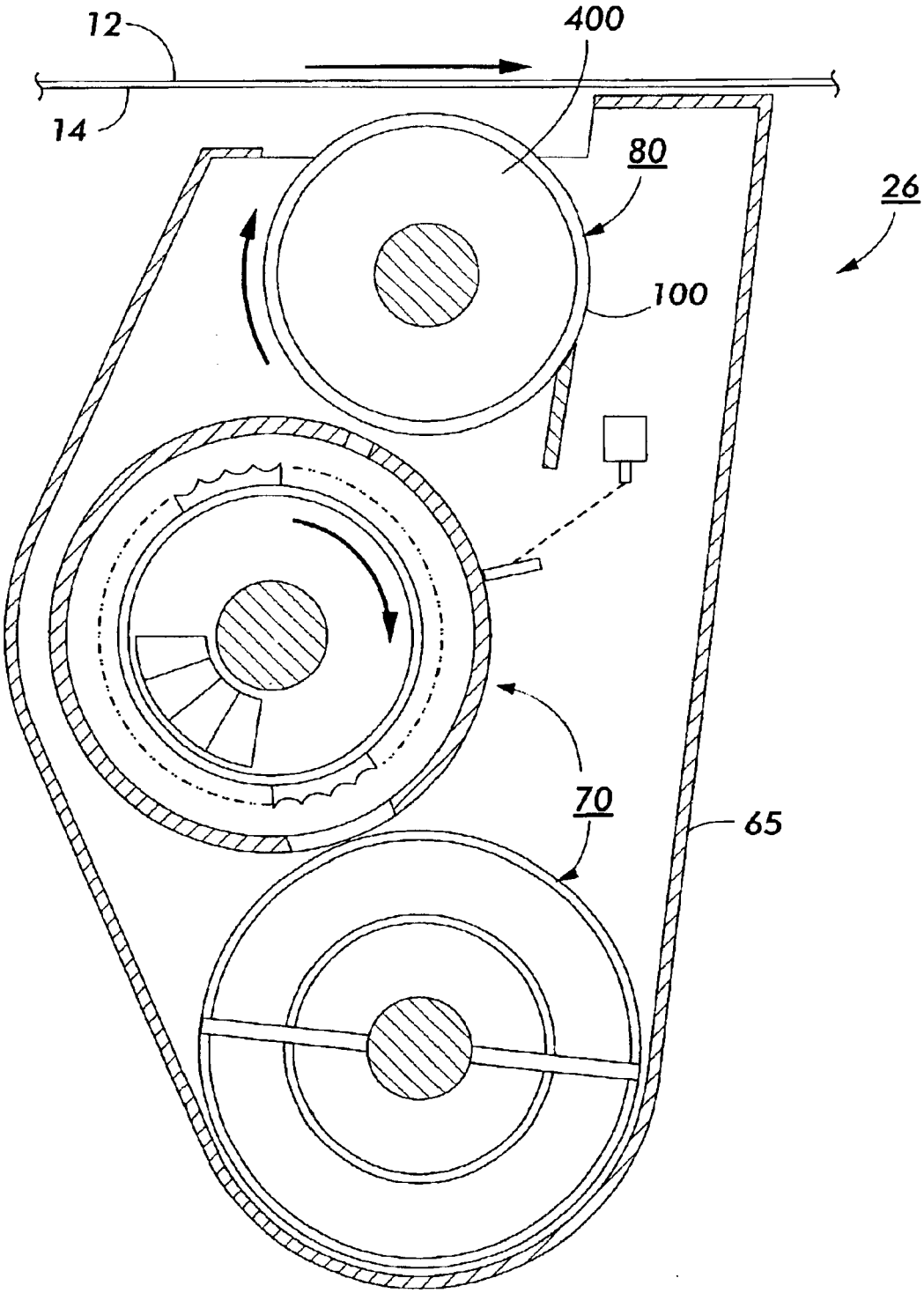
FIG. 4 is an enlarged side view of the developer assembly shown in FIG. 3 in a rotating tubular sleeve configuration.

Referring to FIG. 3 of the drawings, there is shown a xerographic type reproduction machine 8 incorporating an embodiment of the non-interactive development system of the present invention, designated generally by the numeral 80. Machine 8 has a suitable frame (not shown) on which the machine xerographic components are operatively supported. As will be familiar to those skilled in the art, the machine xerographic components include a recording member, shown here in the form of a translatable photoreceptor 12. In the exemplary arrangement shown, photoreceptor 12 comprises a belt having a photoconductive surface 14. The belt is driven by means of a motorized linkage along a path defined by rollers 16, 18 and 20, and those of transfer assembly 30, the direction of movement being counterclockwise as viewed in FIG. 3 and indicated by the arrow marked P. Operatively disposed about the periphery of photoreceptor 12 are charge corotrons 22 for placing a uniform charge on the photoconductive surface 14 of photoreceptor 12; exposure stations 24 where the uniformly charged photoconductive surface 14 constrained by positioning shoes 50 is exposed in patterns representing the various color separations of the document being generated; development stations 28 where the electrostatic image created on photoconductive surface 14 is developed by toners of the appropriate color; and transfer and detack corotrons (not shown) for assisting transfer of the developed image to a suitable copy substrate material such as a copy sheet 32 brought forward in timed relation with the developed image on photoconductive surface 14 at image transfer station 30. In preparation for the next imaging cycle, unwanted residual toner is removed from the belt surface at a cleaning station (not shown).

Following transfer, the sheet 32 is carried forward to a fusing station (not shown) where the toner image is fixed by pressure or thermal fusing methods familiar to those practicing the electrophotographic art. After fusing, the copy sheet 32 is discharged to an output tray.

At each exposure station 24, photoreceptor 12 is guided over a positioning shoe 50 so that the photoconductive surface 14 is constrained to coincide with the plane of optimum exposure. A laser diode raster output scanner (ROS) 56 generates a closely spaced raster of scan lines on photoconductive surface 14 as photoreceptor 12 advances at a constant velocity over shoe 50. A ROS includes a laser source controlled by a data source, a rotating polygon mirror, and optical elements associated therewith. At each exposure station 24, a ROS 56 exposes the charged photoconductive surface 14 point by point to generate the electrostatic image associated with the color separation to be generated. It will be understood by those familiar with the art that alternative exposure systems for generating the electrostatic images, such as print bars based on liquid crystal light valves and light emitting diodes (LEDs), and other equivalent optical arrangements could be used in place of the ROS systems such that the charged surface may be imagewise discharged to form an electrostatic image of the appropriate color separation at each exposure station.

Developer assembly 26 includes a developer housing 65 in which a toner dispensing cartridge (not shown) is rotatably mounted so as to dispense toner particles downward into a sump area occupied by the auger mixing and delivery assembly 70 as taught in U.S. Pat. No. 4,690,096 to Hacknauer et al which is hereby incorporated by reference.

Continuing with the description of operation at each developing station 24, a developing member 80 is disposed in predetermined operative relation to the photoconductive surface 14 of photoreceptor 12, the length of developing member 80 being equal to or slightly greater than the width of photoconductive surface 14, with the functional axis of developing member 80 parallel to the photoconductive surface and oriented at a right angle with respect to the path of photoreceptor 12. Advancement of developing member 80 carries the developer blanket 82 into the development zone in proximal relation with the photoconductive surface 14 of photoreceptor 12 to develop the electrostatic image therein.

A suitable controller is provided for operating the various components of machine 8 in predetermined relation with one another to produce full color images.

Figure 5:
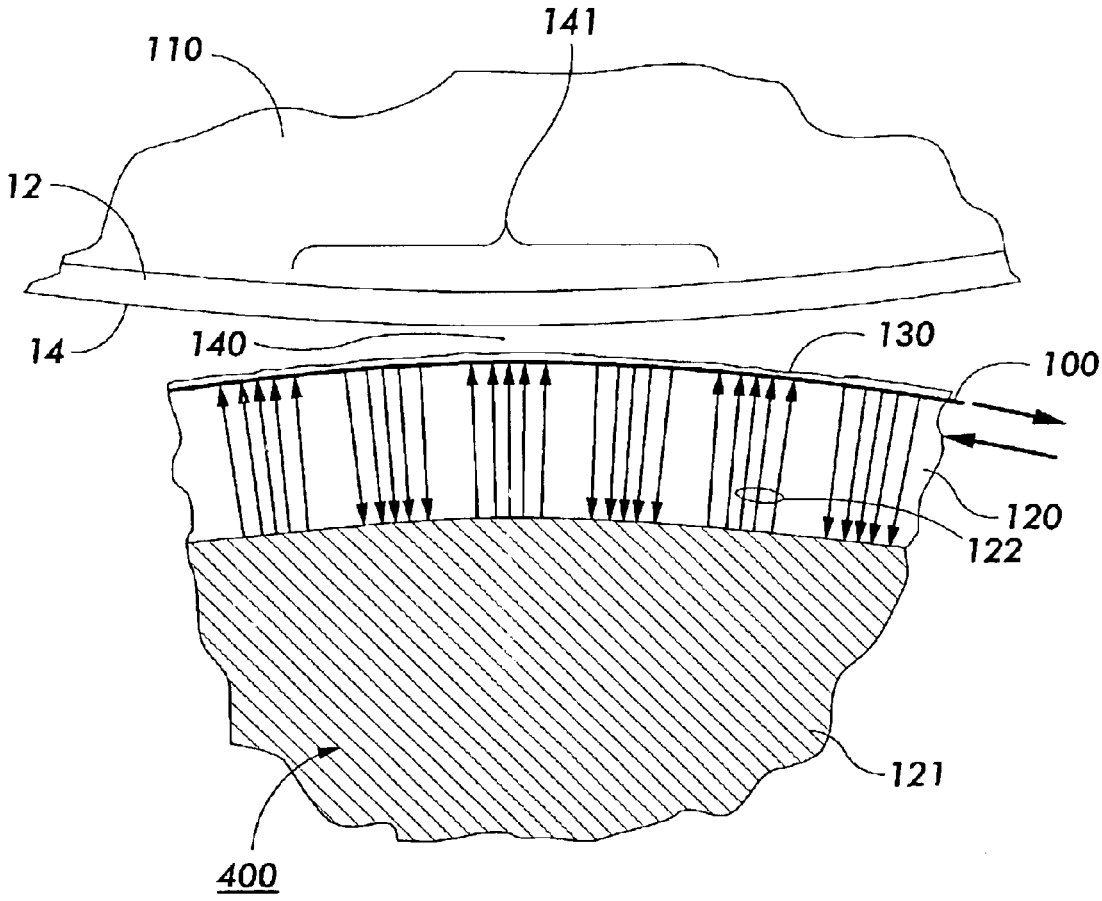
FIG. 5 is an enlarged view of the development zone of the developer assembly shown in FIG. 4.

Further details of the construction and operation of developing member 80 of the present invention are provided below referring to FIGS. 5–6. FIG. 5 shows, on an enlarge view of, photoreceptor 12, a rotatable sleeve 100, and magnet assembly 400. Gap 140 between the photoconductive surface 14 of photoreceptor 12 and the surface of the sleeve 100 is about 0.010 inches at its smallest and is maintained by a suitable mechanical arrangements including backing means 110, for example, a hardened, polished metal shoe. Development occurs in development zone 141. Magnet assembly 400 comprises an outer layer of permanent drive magnet 120 bonded to a cylindrical core 121 of iron or other soft magnet material. Magnet 120 contains regions of alternating magnetic polarization 122 arranged to create a multipole structure. Preferably the density of magnetization is a pure sinusoid with a period of about 2 mm, that is the magnet assembly has a pole spacing of about 1 mm. Sleeve 100 and magnet assembly 400 are made to rotate relative to one another about a common axis by suitable mechanical means. Preferably sleeve 100 is also rotated by these means relative to developer housing 26. It is known that the relative motion of sleeve 100 and magnet assembly 400 generate a rotating magnetic drive field (not shown) in a reference frame fixed to the surface of sleeve 100. A thin developer layer 130 is held on the surface of sleeve 100 and out of contact with photoconductive surface 14 by the gradient in the magnetic field generated in drive magnet 120. Developer layer 130 comprises about two monolayers worth of toner-bearing carrier beads 200 not visible on the scale of this figure.

Sleeve 100 can be fabricated using known methods such as electroforming non-magnetic metals on a cylindrical mandrel. Sleeve 100 is thin flexible, preferably the sleeve has a thickness between 0.001 to 0.008 inches. preferably the sleeve is composed of non-magnetic metal, such as selected from a group consisting of nickel-phosphorous, brass, and copper. Sleeve 100 closely conforms to magnetic assembly 400. Magnetic assembly 400 contains a composite containing at least 60% by volume neodymium-boron-iron hard magnet alloy In operation and has pole spacing between 0.5 and 2.0 millimeters. Sleeve 100 rides on the bearing surfaces as sleeve 100 rotates about magnetic assembly 400. The bearing surfaces allow relative rotation, and uniform support which supplies strength to the sleeve which prevent tendency for the sleeve to buckle under torque supplied from the end. It should be noted that lubricating films may be applied over the bearing surfaces to reduce friction.

Figure 6:
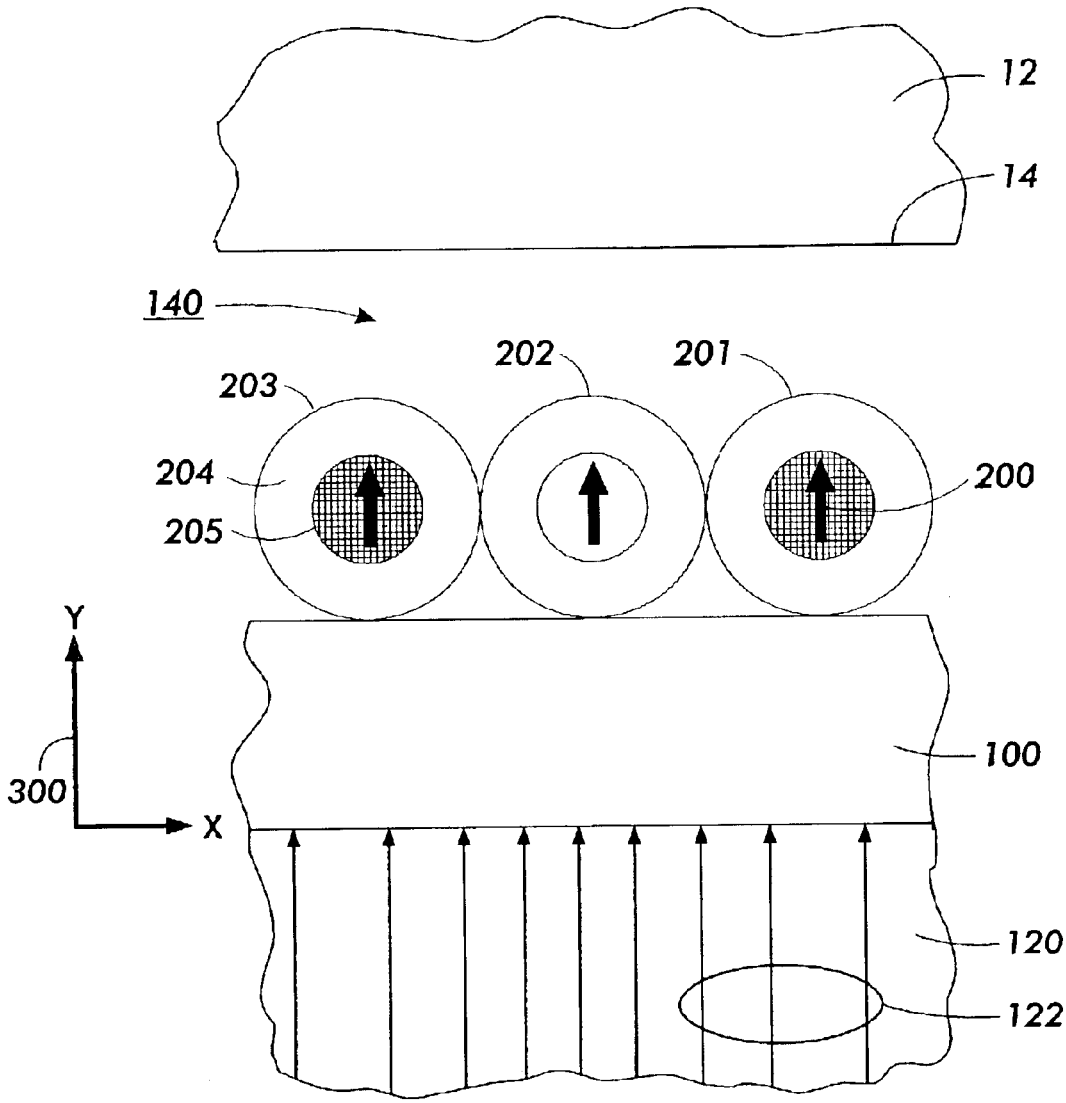
FIG. 6 is an enlarged cross section view of the view of FIG. 5 showing developer material in a particular configuration corresponding to a magnetostatic potential energy $U_I$.

FIG. 6 shows in finer scale a portion of development zone 141. On this scale the relative curvature of sleeve 100 and drive magnet 120 is small, and it is an acceptable approximation to regard the region as flat. Layer 140 comprises permanently magnetized thickly coated carrier beads such as beads 201, 202, 203, preferably each being formed of an uncoated permanently magnetized bead core 205 having thereon a non-magnetic coating 204 of substantial thickness. The magnetized carrier beads exhibit an bead core radius r of about 25 to 50 microns and a coated bead radius a of about 50 to 100 microns, shown for the purposes of illustration as being arranged in a close packed monolayer. The permanently magnetized carrier beads are magnetized along the direction of the arrows 200, which represent the magnetic dipole moments of the beads. The permanently magnetized carrier beads are oriented by the magnetic fields (not shown) due to a pole of the drive magnet 120 directly beneath. Equivalently, these fields arise from magnetic polarization 122, which has been drawn to a new scale relative to that of FIG. 5. Magnetic fields are nearly uniform and vertical so bead moments 200 are nearly parallel. A particular bead 202 is shown unshaded for purposes of illustration. In prior art methods bead configurations like that of FIG. 6 are energetically unstable. Let the magnetostatic energy of the configuration of FIG. 6 be designated $U_I$.

In the event that the bead 202 should move to a pocket formed by three supporting beads to form what is evidently a shortest possible chain, bead 202 will have moved upward in the field gradient of the drive magnet 120 to a more head to tail relationship with the three supporting beads, thereby decreasing the magnetostatic energy of bead-bead interaction and increasing the magnetostatic energy of interaction between the bead magnetic moment 200 and the gradient of the multipole magnet. In prior art devices the shortest chain of FIG. 7 can form spontaneously because the bead-bead interaction is the stronger force. Let the magnetostatic energy of such shortest possible chain configuration be designated $U_{II}$.

My invention is directed to the reduction of bead chains, arid can prevent the formation of even a short chain by making $U_{II}>U_I$. It does so by weakening the bead-bead interaction relative to the interaction between a bead and the gradient of the drive field. It will be evident that a condition preventing formation of a short chain also prevents the formation of any longer chain, because to form a longer chain requires even more energy, provided the beads considered stay in the strong gradients of the drive field. Quantitatively, my invention requires selecting magnetic design parameters for which $U_{II}>U_I$. To do so is a problem in magnetostatics that is solved approximately in the APPENDIX of my above-referenced U.S. Pat. No. 5,946,534. The solution disclosed therein is expressed in terms of a parameter C given by:

$$C \equiv 2.2\left(\frac{M_0}{M_b}\right)e^{-kt}ka,$$

where $M_0 \equiv$ drive magnet peak magnetization, $M_b \equiv$ bead magnetization, $k \equiv \frac{2\pi}{\lambda}$ $\lambda \equiv 2$(pole spacing), $t \equiv$ sleeve thickness, and $a \equiv$ bead radius;

and the condition $U_{II}>U_I$ will occur about when C less than or equal to 1.

According to the present invention, reduction in the dipole moment of the carrier beads, consequent reduction in bead-bead interaction, and the achievement of the desired condition $U_{II}>U_I$ may be further achieved by providing carrier beads of radius a comprising a hard magnetic core of radius r surrounded by a magnetically inert coating of substantial thickness (a−r). Recalling that the magnetic dipole moment strength $\mu$ of a uniformly magnetized sphere is determined as:

$$\mu=M_bV=M_b(4/3)\pi r^3$$

where $M_b$=magnetization of the sphere material and r=sphere radius, I have found that the carrier bead magnetic dipole moment may be controlled for any given, fixed magnetic material such as a ferrite, by adjusting the ratio r/a which is described herein as K.

The computation of C as disclosed in U.S. Pat. No. 5,946,534 was based on the physics of closely-spaced, interacting magnetic dipoles. Applied to the consideration of the thickly coated carrier beads of the present invention as disclosed herein, the condition for C becomes:

$$C = 2.2\left(\frac{M_0}{M_b}\right)\frac{1}{K^3}e^{-kt}ka$$

In addition to the advantage of affording easier control of the magnetic moment of the disclosed coated carrier beads that may be constructed using commonly available magnetic materials, the present invention offers other advantages in the manufacturing process, wherein the coated carrier beads must be pulse magnetized in bulk. The bead geometry of U.S. Pat. No. 5,946,534 permits close bead-bead magnetic interaction, which, I have found, may promote the creation of undesirable higher order magnetic moments during the manufacturing step of bulk carrier bead magnetization. A thickly coated carrier bead geometry, accomplished according to the present invention, is expected to separate the magnetic parts of each bead and advantageously promote pure dipole magnetization.

Accordingly, with r and a so defined (and as illustrated in FIG. 6), I have found that the ratio K may be advantageously controlled during the composition and production of the magnetized carrier beads so as to effectively provide a magnetized carrier bead that exhibits a reduced magnetic dipole moment. In particular, with the uncoated bead core radius r being of a first predetermined amount, and the coated bead radius a being of a second predetermined amount, a ratio K being less than approximately ¾, and preferably less than about ½, the resulting thickly coated carrier bead is expected to exhibit a much weakened level of bead-bead interaction and thus its use will enhance the desired provision of a compressed developer material bed height, when used in conjunction with exemplary values of the drive fields, sleeve thickness, and carrier bead materials disclosed in U.S. Pat. No. 5,946,534; for example, with a magnetic core having an about 1 mm magnetic pole spacing and the rare earth magnet composition described herein, and a thin sleeve thickness (t).

Preferably, the beads in a developer material layer should slightly exceed a bare monolayer in the development zone, in fact a compressed developer bed height of an equivalent of about two monolayers in developer layer 130 is preferred in order to increase the rate at which developable toner is carried into development zone 140. In this case, the criterion for preventing chain formation may be applied in the second layer of beads while regarding the first layer of beads to be an addition to the thickness t of sleeve 100.

What is claimed is:

1. Apparatus for non-interactive, dry powder development of electrostatic images comprising:

an image bearing member bearing an electrostatic image;

a housing containing two component developer comprising toner and permanently magnetized thickly coated carrier beads, the beads having a carrier bead core radius r, a coated carrier bead radius a, and a magnetization $M_b$, and wherein the ratio K of the radius r to the radius a is a quantity less than about ¾;

a developer transporting member, disposed in said housing, having a predefined thickness (t) for transporting a developer layer of said two component developer, said layer spaced close to and out of contact with said image bearing member; and a multipole magnet member disposed in close proximity behind said transporting member, and moving relative to it so as to sweep poles across its surface, said magnet member having a predefined periodic magnetization of spatial frequency (k) and a predefined peak magnetization ($M_0$).

2. Apparatus according to claim 1, wherein the ratio K of the radius r to the radius a is a quantity less than about ½.

3. Apparatus according to claim 1, wherein said parameters a, $M_b$, t, k, K, and $M_0$, are chosen such that $M_b$ is sufficiently large to prevent the escape of said developer, and the quantity C in the equation $$C = 2.2\left(\frac{M_0}{M_b}\right)\frac{1}{K^3}e^{-kt}ka$$

is greater than about ⅓.

4. Apparatus according to claim 1, wherein parameters a, $M_b$, t, k, K, and $M_0$, are chosen such that $M_b$ is sufficiently large to prevent the escape of said developer and the quantity C in the equation $$C = 2.2\left(\frac{M_0}{M_b}\right)\frac{1}{K^3}e^{-kt}ka$$

is greater than about 1.

5. Apparatus according to claim 1, wherein said carrier comprises hard ferrite powder selected from a group consisting of barium ferrite and strontium ferrite, and is combined with magnetically inert material in a volume ratio of less than 1 to 2.

6. Apparatus according to claim 1, wherein said developer transporting member is in the form of a non-magnetic cylindrical sleeve having a thickness of from about 0.001 to 0.008 inches.

7. Apparatus according to claim 6, wherein said sleeve is strengthened and supported over its internal area by said multipole magnet member.

8. Apparatus according to claim 6, wherein said sleeve is made by electroforming metals selected from a group consisting of nickel-phosphorous, brass, and copper.

9. Apparatus according to claim 1, wherein said multipole magnet member is comprised of a composite containing at least 60% by volume neodymium-boron-iron hard magnet alloy.

10. Apparatus according to claim 1, wherein said multipole magnet member has pole spacing between about 0.5 and 2.0 millimeters.

11. A method for generating a substantially condensed developer layer on a developer roll, comprising the steps of:

assembling a developer magnetic assembly said magnetic assembly having a predefined periodic magnetization of spatial frequency (k) and a predefined peak magnetization ($M_0$);

enclosing the developer magnetic assembly with a sleeve of a predefined thickness (t) to form said developer roll;

loading said developer roll with a developer layer of two component developer comprising toner and permanently magnetized thickly coated carrier beads, said magnetized carrier beads having a carrier bead core radius r, a coated carrier bead radius a, and a magnetization $M_b$, and wherein the ratio K of the radius r to the radius a is a quantity less than about ¾; and selecting the predefined thickness (t), the predefined periodic magnetization of spatial frequency (k), and the predefined peak magnetization ($M_0$) to satisfy the following relationship: wherein $M_b$, t, k, and $M_0$, are chosen such that $M_b$ is sufficiently large to prevent the escape of said developer, and the quantity C in the equation:

$$C = 2.2\left(\frac{M_0}{M_b}\right)\frac{1}{K^3}e^{-kt}ka$$

is greater than about ⅓.

12. The method of claim 11, wherein said quantity C is greater than 1.

13. Apparatus for non-interactive, dry powder development of electrostatic images comprising:

an image bearing member for bearing an electrostatic image;

a housing containing a supply of two-component developer comprising toner and permanently magnetized thickly coated carrier beads, said magnetized carrier beads having a carrier bead core radius r, a coated carrier bead radius a, and a magnetization $M_b$, and wherein the ratio K of the radius r to the radius a is a quantity less than about ¾;

a developer transporting member, disposed in said housing, for transporting a developer layer of said two component developer, said layer spaced close to and out of contact with said image bearing member; and a multipole magnet member disposed in close proximity behind said transporting member, and moving relative to it so as to sweep poles across its surface.

14. The apparatus of claim 13, wherein the magnet member further comprises a pole spacing of between 0.5 and 2 millimeters.

15. A carrier bead composition, comprising permanently magnetized, thickly coated carrier beads having carrier bead core radius r, a coated carrier bead radius a, and a magnetically inert coating of substantial thickness (a—r), and a magnetization $M_b$, and wherein the ratio K of the radius r to the radius a is a quantity less than about ¾.

16. The composition of claim 15, wherein the ratio K is a quantity less than about ½.

17. The composition of claim 15, wherein the carrier bead core radius r is in the range of about 25 to 50 microns, the coated carrier bead radius a is in the range of about 50 to 100 microns, and the thickness of the coating is in the range of about 25 to 50 microns.

* * * * *